United States Patent [19]

Bäuerle et al.

[11] Patent Number: 4,746,834

[45] Date of Patent: May 24, 1988

[54] IGNITION PLUG FOR INTERNAL COMBUSTION ENGINES

[75] Inventors: Adalbert Bäuerle, Kornwestheim; Ludwig Barthelmä, Kornwestheim; Walter Benedikt, Kornwestheim; Werner Herden, Gerlingen; Walter Holl, Stuttgart; Gerhard Liebing, Stuttgart; Jürgen Schmatz, Mundelsheim; Siegbert Schwab, Maichingen; Walter Würth, Bietigheim-Bissingen, all of Fed. Rep. of Germany

[73] Assignee: Robert Bosch GmbH, Stuttgart, Fed. Rep. of Germany

[21] Appl. No.: 27,200

[22] PCT Filed: May 10, 1986

[86] PCT No.: PCT/DE86/00198

§ 371 Date: Jan. 20, 1987

§ 102(e) Date: Jan. 20, 1987

[87] PCT Pub. No.: WO86/07207

PCT Pub. Date: Dec. 4, 1986

[30] Foreign Application Priority Data

May 31, 1985 [DE] Fed. Rep. of Germany ..... 3519513
Jan. 10, 1986 [DE] Fed. Rep. of Germany ..... 3600511

[51] Int. Cl.[4] ..... H01N 13/38

[52] U.S. Cl. ..... 313/137; 315/59

[58] Field of Search ..... 313/137; 315/59

[56] References Cited

U.S. PATENT DOCUMENTS 3,295,005 12/1966 Poellet et al. ..... 313/137
4,549,114 10/1985 Herden ..... 315/59 X
4,568,855 2/1986 Nemeth et al. ..... 313/137 X

*Primary Examiner*—Palmer C. DeMeo

[57] ABSTRACT

An ignition plug suitable for igniting meager fuel vapor-/air mixtures has a tubular metal housing, an insulating body which is divided into longitudinal portions and contains a connection pin and a middle electrode positioned in its through borehole. A longitudinal portion of the insulating body, which longitudinal portion is enclosed by the metal housing, consists of dielectric material and, together with the metal housing and the connection pin, forms a capacitor which has a capacity of 120 to 500 pF, chiefly 200 to 400 pF. In order to connect electrial flashovers between the connection pin and the metal housing in the areas of the separating surfaces of the insulating body annular electrical insulating elements are arranged between the separating surfaces which are made of the material elastic at all temperatures of the ignition plug.

10 Claims, 1 Drawing Sheet

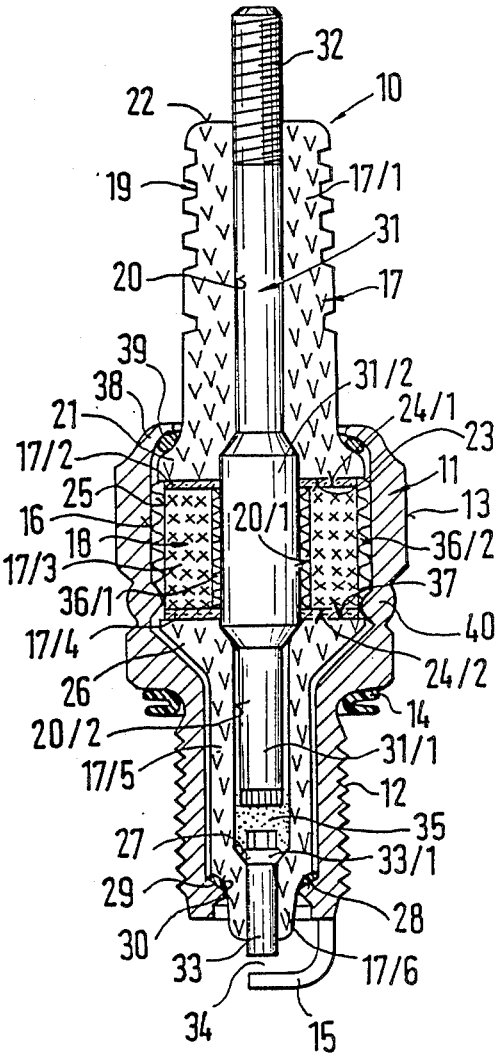
32
10
22
19
17/1
31
20
17
39
38
31/2
24/1
21
23
17/2
11
25
13
16
20/1
18
36/2
17/3
37
36/1
40
17/4
24/2
26
14
20/2
31/1
17/5
12
35
27
33/1
29
28
30
33
17/6
34
15

IGNITION PLUG FOR INTERNAL COMBUSTION ENGINES

BACKGROUND OF THE INVENTION

The invention relates to an ignition plug. Such an ignition plug, which is known for example from DE-OS No. 23 63 804, has a capacitor which is built into the ignition plug and arranged so as to be electrically parallel with respect to the spark gap. This capacitor should store enough energy in the vicinity of the spark gap of the ignition plug so that the ionizing initial phase of the spark during the sparking passage at the spark gap of the ignition plug brings about a sure ignition of the fuel vapor/air mixture found in the internal combustion engine. The aforementioned DE-OS No. 23 63 804 also describes such an ignition plug which, in addition, has a preliminary spark gap which is likewise built into the ignition plug and is electrically connected in series with the spark gap. However, the aforementioned DE-OS discloses no indications of an embodiment form of such an ignition plug which can be realized in an economical manner and whose functioning is ensured.

Another ignition plug with a built-in capacitor is known from DE-OS No. 34 04 081; the insulating body of this ignition plug, which comprises a plurality of longitudinal portions, has an average dielectric constant such that this ignition plug has a capacity of 20 to 100 pF, preferably 30 to 80 pF. However, the capacitor of this ignition plug has the object of reducing or suppressing the electromagnetic interference of the internal combustion engine so as to prevent disturbances in radio and television equipment and the like.

SUMMARY OF THE INVENTION

It is an object of this invention to provide an, the ignition plug, according which can be realized in an economical manner and is able to ignite even meager fuel vapor/air mixtures under all operating conditions of an internal combustion engine reliably and for the duration of the required service life.

It is particularly advantageous if annular elements for electrical insulation are arranged between the separating surfaces extending transversely through the ceramic insulating body of the ignition plug, which annular electrical insulation elements securely contact the separating surfaces and consist of a material which is elastic at all temperatures occurring in this area; for example, these elements can consist of silicon rubber or correspondingly adjusted epoxy resin. Moreover, it is advisable that the affected separating surfaces of the insulating body have a roughness depth $R_Z$ of less than 30 $\mu$m; this can be achieved, for example, by means of a glaze. In accordance with the German industrial standard, roughness depth $R_Z$ designates the average value of the individual roughness values $Z_1 \ldots Z_5$ of five consecutive individual measured lengths. Due to this type of assembly of the insulating body, no expensive sintering equipment is required for the connection of the longitudinal portions of the insulating body and a reliable storage of electrical energy in the ignition plug is nevertheless ensured.

In order to reduce the electrode wear, and a possible spark glide path erosion, and thus improve the operating reliability and service life in such ignition plugs it is advantageous to leave gas gaps of 0.01 to 0.50 mm, but preferably 0.05 to 0.30 mm, between the dielectric structural cmponent part and the structural component parts which are in a working connection with the latter (connection pins, metal housing); air is preferably used as gas.

BRIEF DESCRIPTION OF THE DRAWING

The single FIGURE of the drawing shows a longitudinal section through an ignition plug, according to the invention, on enlarged scale.

DETAILED DESCRIPTION OF THE PREFERRED EMBODIMENT

The ignition plug 10 shown in the drawing has a substantially tubular metal housing 11 which, as means for the installation of this ignition plug 10 in a motor cylinder head (not shown), comprises on its outside a screw-in thread 12, a wrench hexagon 13 and a sealing ring 14. In the area of its end on the combustion chamber side, this metal housing 11 has a hook-shaped ground electrode 15, which is constructed in the present example as a welded on wire but can also have a different shape; instead of a single ground electrode 15; a plurality of such ground electrodes, depending on the use, can also be attached at the metal housing 11. In a known manner, the metal housing 11 comprises an electrical insulating body 17 positioned in its longitudinal borehole 16, which electrical insulating body 17 is symmetrical with respect to axis of rotation and usually projects out of the through borehole 16 of the metal housing 11 on the connection side. This electrical insulating body 17 is divided into a plurality of longitudinal portions, specifically the insulating body head 17/1, which projects out of the metal housing 11 on the connection side, an annular electrical insulating element 17/2, which adjoins the insulating body head 17/1 on the side of the combustion chamber, a dielectric structural component part 17/3 of a capacitor 18, which dielectric structural component part 17/3 adjoins the electrical insulating element 17/2 on the combustion chamber side, a second electrical insulating element 17/4, which adjoins the dielectric structural component part 17/3 on the combustion chamber side, and an insulating body shaft 17/5 with the insulating body foot 17/6, which latter projects out of the metal housing 11, preferably on the combustion chamber side, which insulating body shaft 17/5 adjoins the second electrical insulating element 17/4 on the combustion chamber side.

The insulating body head 17/1 which substantially consists of aluminum oxide in a known manner comprises a quantity of annular grooves 19 on its surface as so-called leakage current barriers, and is provided with a through borehole 20, which extends coaxially relative to the longitudinal borehole 16 of the metal housing 11, and has an end portion on the combustion chamber side which is constructed as a flange 21. The end face of the insulating body head 17/1 remote of the combustion chamber is designated by 22 and the end face of this insulating body head 17/1 on the combustion chamber side, which end face extends transversely relative to the longitudinal axis of the insulating body 17, is designated as separating surface 23. This separating surface 23 of the insulating body head 17/1 has a surface whose roughness depth $R_Z$ should be smaller than 30 $\mu$m, if possible, preferably even smaller than 5 $\mu$m; this smaller roughness depth can best be achieved in that a glaze (not shown) is applied to this surface which has a layer thickness of less than 40 $\mu$m and which is producible, for example, from a commercially available glass paste No. 9137 from the firm of Dupont.

The two electrical insulating elements 17/2 and 17/4 consist of a material which is elastic at all temperatures occurring in this area of the ignition plug 10. Such an electrical insulating element 17/2 or 17/4 can consist, for instance, of an annular plate of silicon rubber which has a thickness of 1 mm, for example, and a Shore hardness of 50. However, the thickness of such electrical insulating elements 17/2, 17/4 can also be between 0.1 and 2 mm. However, instead of silicon rubber, a material can also be used which is applied to a separating surface (e.g. position 23) in liquid, nonrigid or viscous form and is possibly subjected to an aftertreatment (e.g. polymerization) after the respective longitudinal portions 17/1 to 17/5 of the insulating body 17 are joined together; for example, a suitable material for this could be an epoxy resin or the like, which is correspondingly adjusted with respect to elasticity and to which filling materials (e.g. aluminum oxide, talcum, silicate) were possibly added in a known manner in order to compensate for the differing thermal expansion behavior of the respective longitudinal portions of the insulating body 17.

The dielectric structural component part 17/3, which belongs to the capacitor 18, adjoins the electrical insulating element 17/2 on the combustion chamber side, has a tubular shape, comprises a through borehole 20/1 which extends coaxially relative to the through borehole 20 of the insulating body head 17/1, securely contacts the electrical insulating element 17/2 with its separating surface 24/1 on the side remote of the combustion chamber and securely contacts the second electrical insulating element 17/4 with its separating surface 24/2 on the combustion chamber side. These two separating surfaces 24/1 and 24/2 of the dielectric structural component part 17/3 also have a roughness depth $R_Z$ which is equally as small as described above with respect to the separating surface 23 of the insulating body head 17/1 and can also be coated with a corresponding glaze (not shown). The circumferential surface 25 of the dielectric structural component part 17/3 preferably has a diameter which is slightly smaller than the diameter of the flange 21 of the insulating body head 17/1; both the circumferential surface 25 and the surface of the through borehole 20/1 of this dielectric structural component part 17/3 are provided with a surface coating (not characterized in addition) which supports the electrical contact and which can consist, for example, of a silver/palladium alloy and has a thickness of 10 μm. The dielectric structural component part 17/3 consists of a material with a dielectric constant $\epsilon_r$ of 100 to 500; for example, a suitable material is available commercially from the Japanese firm Murata (type QQ or UF) and can consist, for example, of a mixture of calcium titanate, strontium titanate, bismuth oxide and lead titanate or also of calcium titanate and strontium titanate. This dielectric structural component part 17/3 is dimensioned in such a way that the finished ignition plug 10 has a capacity of 120 to 500 pF, but preferably has a capacity of 200 to 400 pF.

The next structural component part following the electrical insulating element 17/4, which adjoins the dielectric structural component part 17/3 on the combustion chamber side, is the insulating body shaft 17/5 whose end portion remote of the combustion chamber is constructed as a flange 26 and is equipped with a through borehole 20/2; the through borehole 20/2 has a shoulder 27 facing the connection side of the ignition plug 10. The insulating body shaft 17/5 also has at its outside an annular shoulder 28 which is directed toward the combustion chamber side and forms the transition to the so-called insulating body base 17/6; the insulating body shaft 17/5 rests with this annular shoulder 28 on a ring shoulder 30 found in the longitudinal borehole 16 of the metal housing 11 by way of a so-called internal sealing ring 29. Like the insulating body head 17/1, the insulating body shaft 17/5 likewise consists substantially of sintered aluminum oxide or the like material.

As already described above, the through borehole 20 of the insulating body head 17/1, the through borehole 20/1 of the dielectric structural component part 17/3 and the through borehole 20/2 in the insulating body shaft 17/5 extend coaxially relative to one another. Arranged within these through boreholes 20, 20/1 and 20/2 is a metallic connection pin 31 which carries a connection thread 32 at its end portion remote of the combustion chamber and projects from the insulating body head 17/1 on the side remote of the combustion chamber, penetrates the through borehole 20/2 of the insulating body shaft 17/5 with its end portion 31/1 on the combustion chamber side and has a rollerlike middle portion 31/2 which has a somewhat larger outer diameter than the areas of the connection pin 31 remote of the combustion chamber and on the combustion chamber side; the transition of the rollerlike middle portion 31/2 to the two end portions of the connection pin 31 is preferably constructed so as to be shaped like a truncated cone and are accordingly also adapted to the through borehole 20 of the insulating body head 17/1 and the through borehole 20/2 of the insulating body shaft 17/5.

In that area of the through borehole 20/2 of the insulating body shaft 17/5 which is substantially formed by the insulating body base 17/6 is located the metallic middle electrode 33, which rests on the annular shoulder 27 in the through borehole 20/2 of the insulating body shaft 17/5 with its head 33/1 which is remote of the combustion chamber; the so-called spark gap 34, the one ground electrode 15 or also a plurality of ground electrodes, is at a distance relative to the end of the middle electrode 33 in the vicinity of the combustion chamber.

For the purpose of the gastight sealing of the through borehole 20/2 and also for the electrical connection of the connection pin 31 with the middle electrode 33 a known electrically conducting glass melt 35 is introduced between the middle electrode head 33/1 and the end portion 31/1 of the connection pin 31 on the combustion chamber side, as known, for example, from the U.S. Pat. No. 3,360,676; anchoring means, which are not further characterized here, are preferably attached on the end portion 31/1 of the connection pin 31 on the combustion chamber side as well as on the middle electrode head 33/1 for the electrically conducting glass melt 35.

In order to ensure the electrical connection between the rollerlike middle portion 31/2 of the connection pin 31 and the dielectric structural component part 17/3, as well as for a good electrical connection between the dielectric structural component part 17/3 and the metal housing 11, a contact sleeve 36/1 or 36/2, which can consist of a steel screen with small mesh (e.g. 200 to 300 μm) and has a thickness of 0.1 to 0.5 mm, is arranged between the respective surfaces in each instance. The contact sleeves 36/1 or 36/2 can be arranged in an upright manner on the electrical insulating element 17/4 on the combustion chamber side, which electrical insulating element 17/4 is arranged between the separating surface 24/2 of the dielectric structural component part 17/3 on the combustion chamber side and the end face of the insulating body shaft 17/5 remote of the combustion chamber, the end face of the insulating body shaft 17/5 being designated as separating surface 37.

However, instead of these contact sleeves 36/1 and 36/2, other means can be used to support the electrical contact between the respective parts such as an electrically conductive cast mass, graphite packings or the like.

It has been shown, however, that instead of the aforementioned contact sleeves 36/1 and 36/2 or electrical masses between the dielectric structural component part 17/3 and the connection pin 31 or the metal housing 11, a gas gap of a specified width is a considerable advantage for the reduction of wear of electrodes and possibly also of the erosion of a spark glide path of such ignition plugs; these measures would thus bring about a longer service life and reliability of operation of these ignition plugs and would, moreover, bring about a saving in production costs. The reduced wear of the electrodes or of a spark glide path results from the energy converted in the ring gaps—which function as secondary spark gaps—during the glow and arc phases of the spark, which energy relieves the main spark gap 34 between the middle electrode 33 and the ground electrode 15. The gas gap, which is located between the dielectric structural component part 17/3 and the metal housing 11, should have a width of 0.01 and 0.50 mm, preferably between 0.05 and 0.30 mm; a gap of this magnitude stays electrically conductive within a voltage range of 5,000 V to 500 V. In the simplest instance, air is a suitable gas; if other gases (e.g. nitrogen) are to be used in special cases, the two annular electrical insulating elements 17/2 and 17/4 must be constructed in such a way that they are disposed at the rollerlike middle portion 31/2 and in the longitudinal borehole 16 of the metal housing 11 so as to seal.

The end portion of the metal housing 11 remote of the combustion chamber is constructed as a flange rim 38 and, by means of a flange ring 39 which rests on the side of the flange 21 of the insulating body head 17/1 remote of the combustion chamber, presses the insulating body head 17/1 firmly on the first electrical insulating element 17/2, the dielectric structural component part 17/3, the second electrical insulating element 17/4, the insulating body shaft 17/5 and the inner sealing ring 29 against the ring shoulder 30 in the longitudinal borehole 16 of the metal housing 11 and accordingly ensures a secure joining together of the aforementioned structural component parts. In order to make the gap found between the aforementioned structural component parts and the longitudinal borehole of the metal housing 11 gastight the metal housing 11 is subjected to the known heat shrinkage process in addition (see, e.g. U.S. Pat. No. 2,111,916), which is to be seen in the heat shrinkage area 40 of the metal housing 11.

The capacitor 18 of this ignition plug 10 is accordingly formed between the connection pin 31 and the metal housing 11, as capacitor electrode, and the dielectric structural component part 17/3 and is connected in parallel relative to the spark gap 34 of the ignition plug 10; the required characteristics of this capacitor 18 were already described above.

It may also be advisable, depending on the embodiment form of the respective internal combustion engine, to install a preliminary spark gap in the end portion 31/1 of the connection pin 31 in addition, the preliminary spark gap preferably being tightly encapsulated, as is known, for example, in principle from the U.S. Pat. No. 3,742,280.

Finally, it is noted in particular that there is no need to sinter together the three ceramic structural component parts 17/1, 17/3 and 17//5 in large and expensive sintering arrangements due to the electrical insulating elements 17/2 and 17/4, which is a considerable advantage for a manufacturing line for these ignition plugs.

It will be understood that each of the elements described above, or two or more together, may also find a useful application in other types of ignition plugs for internal combustion engines differing from the types described above.

While the invention has been illustrated and described as embodied in an ignition plug for internal combustion engines, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. In an ignition plug for internal combustion engines, comprising a tubular metal housing, which is provided with fastening means for installation in an internal combustion engine, at least one ground electrode at an end portion thereof on a combustion chamber side, said housing having a longitudinal borehole, an electrical insulating body, at least one longitudinal portion of which is inserted in said borehole in a gastight manner, said insulating body at least partially forming a dielectric structural component part which is in an operating connection with said metal housing and comprises a through borehole; a connection pin enclosed in said through borehole and seated in the latter; a middle electrode positioned in said through borehole; said connection pin being in an operating connection with said dielectric structural component part and electrically connected on the combustion chamber side with said middle electrode which is in an operating connection with said at least one ground electrode via a spark gap, the improvement comprising said insulating body (17) being formed of a plurality of longitudinal portions (17/1 to 17/5), at last one (17/3) of which is said dielectric structural component part, which is dimensioned in such a way that it imparts to said ingition plug (10) a total capacity of 120 to 500 pF, some of said longitudinal portions being annular electrical insulating elements (17/2, 17/4) arranged between separating surfaces (23, 24/1, 24/2, 37) extending transversely through said insulating body (17), said electrical insulating elements (17/2, 17/4) resting securely against respective separating surfaces (23, 24/1; 24/2, 37) and being made of a material which is elastic at all temperatures occurring in this area of said ignition plug (10).

2. Ignition plug according to claim 1, wherein it has a capacity of 200 to 400 pF.

3. Ignition plug according to claim 1, wherein said annular electrical insulating elements (17/2, 17/4) are formed of silicon rubber.

4. Ignition plug according to claim 1, wherein said annular electrical insulating elements (17/2, 17/4) are made of a material which is applied to said separating surfaces (23, 24/1, 24/3, 37) of said insulating body (17) so as to be liquid, nonrigid or viscous and are subjected to an after-treatment after respective longitudinal portions (17/1, 17/3, 17/5) of said insulating body (17) are joined together.

5. Ignition plug according to claim 4, wherein said annular electrical insulating elements (17/2, 17/4) are made of epoxy resin to which filling materials are added in order to compensate for differing thermal expansion behavior of said respective longitudinal portions (17/1, 17/3, 17/5) of said insulating body (17).

6. Ignition plug according to claim 1, wherein said separating surfaces (23, 24/1, 24/2, 37) of said respective longitudinal portions (17/1, 17/3, 17/5) of said insulating body (17) have a roughness depth ($R_Z$) of less than 30 $\mu$m.

7. Ignition plug according to claim 6, wherein said separating surfaces (23, 24/1, 24/2, 37) of said respective longitudinal portions (17/1, 17/3, 17/5) of said insulating body (17) have a roughness depth ($R_Z$) of less than 5 $\mu$m.

8. Ignition plug according to claim 1, wherein said separating surfaces (23, 24/1, 24/2, 37) of the insulator (17) is provided with a layer of glaze.

9. In an ignition plug for internal combustion engines, comprising a tubular metal housing, which is provided with fastening means for installation in an internal combustion engine, at least one ground electrode at an end portion thereof on a combustion chamber side, said housing having a longitudinal borehole, an electrical insulating body, at least one longitudinal portion of which is inserted in said borehole in a gastight manner, said insulating body at least partially forming a dielectric structural component part which is in an operating connection with said metal housing and comprises a through borehole; a connection pin enclosed in said through borehole and seated in the latter; a middle electrode positioned in said through borehole; said connection pin being in an operating connection with said dielectric structural component part and electrically connected on the combustion chamber side with said middle electrode which is in an operating connection with said at least one ground electrode via a spark gap, the improvement comprising said insulating body (17) being formed of a plurality of longitudinal portions (17/1 to 17/5), at last one (17/3) of which is said dielectric structural component part, which is dimensioned in such a way that it imparts to said ignition plug (10) a total capacity of 120 to 500 pF, wherein an annular gap between a middle portion (31/2) of said connection pin (31) and said dielectric structural component part (17/3) and an annular gap between said dielectric structural component part (17/3) and said metal housing (11) is each 0.01 to 0.50 mm wide, each gap being filled only with gas.

10. Ignition plug according to claim 9, wherein said annular gaps are 0.05 to 0.30 mm wide.

* * * * *